US006832901B2

(12) United States Patent
Kuehn et al.

(10) Patent No.: US 6,832,901 B2
(45) Date of Patent: Dec. 21, 2004

(54) AGGREGATE FOR CONVEYING FUEL

(75) Inventors: Michael Kuehn, Bietigheim-Bissingen (DE); Udo Willmes, Reichenkirchen (DE); Hans-Joerg Fees, Bietigheim-Bissingen (DE); Lorenz Drutu, Moeglingen (DE)

(73) Assignee: Robert Bosch GmbH, Stuttgart (DE)

( * ) Notice: Subject to any disclaimer, the term of this patent is extended or adjusted under 35 U.S.C. 154(b) by 72 days.

(21) Appl. No.: 10/111,088

(22) PCT Filed: Aug. 28, 2001

(86) PCT No.: PCT/DE01/03272

§ 371 (c)(1),
(2), (4) Date: Jul. 22, 2002

(87) PCT Pub. No.: WO02/18798

PCT Pub. Date: Mar. 7, 2002

(65) Prior Publication Data

US 2003/0021708 A1 Jan. 30, 2003

(30) Foreign Application Priority Data

Sep. 1, 2000 (DE) ..... 100 43 068

(51) Int. Cl.[7] ..... F04B 17/00

(52) U.S. Cl. ..... 417/423.1; 417/423.14; 417/423.3; 417/423.15

(58) Field of Search ..... 417/423.1, 360, 417/423.14, 423.15, 423.3

(56) References Cited

U.S. PATENT DOCUMENTS

RE29,445 E * 10/1977 Nusser et al. ..... 417/423.1
4,566,866 A * 1/1986 Kemmner ..... 417/423.7
5,399,075 A * 3/1995 Frank et al. ..... 417/423.1
6,659,713 B1 * 12/2003 Fujii et al. ..... 417/423.14
6,688,844 B2 * 2/2004 Yu ..... 417/423.3

FOREIGN PATENT DOCUMENTS

DE 33 21 241 A 12/1984 ..... 417/423.1
DE 42 01 401 A 7/1993 ..... 417/423.1
DE 44 35 466 A 4/1996 ..... 417/423.1

* cited by examiner

*Primary Examiner*—Cheryl J. Tyler
(74) *Attorney, Agent, or Firm*—Michael J. Striker

(57) ABSTRACT

The unit includes an electric drive motor (12) and a pump section (24) that are situated next to each other in a common housing (10) designed at least nearly in the shape of a hollow cylinder. The pump section (24) comprises a delivery element (26) rotating in a pump chamber (30), and one wall (32, 34) each forms a boundary of the pump chamber (30) with the drive motor (12) and with the outside of the housing (10) in the direction of the axis of rotation (28) of the delivery element (26). The walls (34) forming the boundary of the pump chamber (30) with the outside of the housing (10) is formed as a single component with the housing (10), and the walls (32) forming the boundary of the pump chamber (30) with the drive motor (12) is inserted into the housing (10) as a separate component. Due to the fact that the wall (34) forming the boundary of the pump chamber (30) with the outside is integrated with the housing (10), no separate steps are required to manufacture and assemble said wall and housing, and the pump chamber (30) is sealed off completely from the outside of the housing (10), because no joints are present that would have to be sealed off.

5 Claims, 2 Drawing Sheets

AGGREGATE FOR CONVEYING FUEL

BACKGROUND OF THE INVENTION

The invention is based on a unit for conveying fuel.

Such a unit is made known in DE 44 35 466 A1. This said unit comprises a drive motor and a pump section that has at least one delivery element rotating in a pump chamber. The drive motor and the pump section are situated next to each other in a common housing. One wall forms a boundary of the pump chamber with the drive motor, and another wall forms a boundary of the pump chamber with the housing in the direction of the axis of rotation of the delivery element in each case. The two walls forming the boundaries of the pump chamber are inserted in the housing section as separate parts, whereby the wall situated next to the drive motor is pressed into the housing and is supported against an abutment in the direction of the axis of rotation of the delivery element. The other wall forms a cover section that bears against the pressed-in wall and holds it against the abutment. The wall formed as cover section is pressed into the housing and secured in the housing by means of an edged connection. The disadvantage of this known unit is that it requires considerable production and assembly expense due to the fact that the walls are formed as separate parts. Moreover, the act of pressing the walls into place or edging them deforms the housing, which gives rise to the risk that the walls will come loose and leakage will result.

SUMMARY OF THE INVENTION

In contrast, the unit according to the invention has the advantage that it is easier to produce and assemble. Moreover, the risk of the housing becoming deformed and developing leaks is reduced.

In a further embodiment, the pump chamb r can be sealed off completely from the outside of the housing. The pump chamber also can be sealed completely from the drive motor.

BRIEF DESCRIPTION OF THE DRAWINGS

Two exemplary embodiments of the invention are shown in the drawing and described in greater detail in the subsequent description.

DETAILED DESCRIPTION OF THE PREFERRED EMBODIMENT

Figure 1:
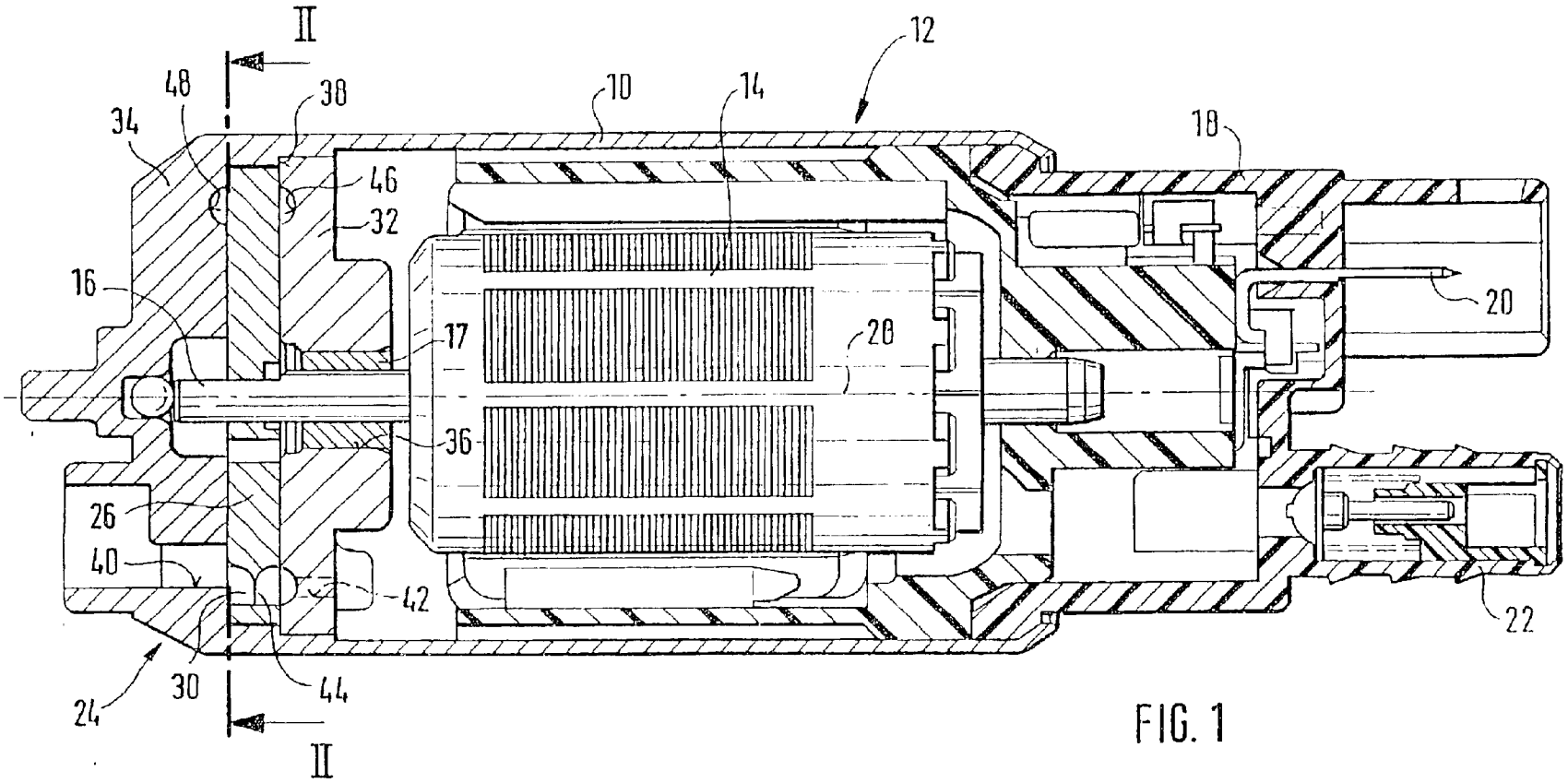
FIG. 1 is a longitudinal view showing a unit for conveying fuel according to a first exemplary embodiment.
Figure 2:
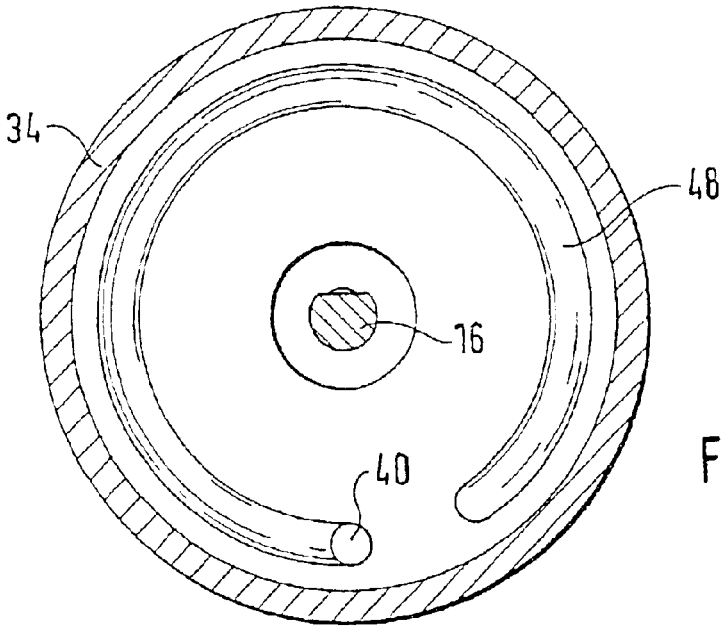
FIG. 2 is a view showing the unit in a cross section along the line II—II in FIG. 1.
Figure 3:
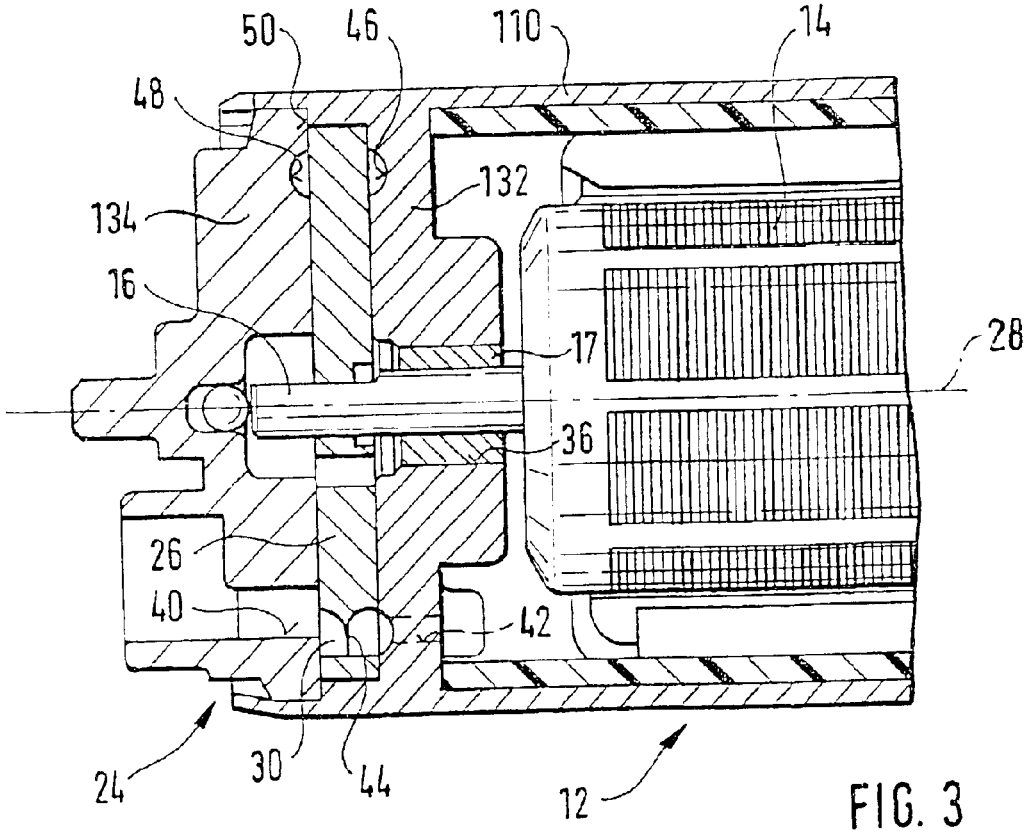
FIG. 3 is a longitudinal view showing the unit according to a second exemplary embodiment.

A unit for conveying fuel is shown in FIGS. 1 through 3, by means of which said unit fuel is conveyed from a storage tank to an internal combustion engine of a motor vehicle. The unit has a housing 10 that is designed at least nearly in the shape of a hollow cylinder. An electric drive motor 12 is situated in the housing 10, which said electric drive motor has an armature 14 with a shaft 16. The housing 10 is closed on a rear side by means of an end cover 18, on which electrical connections 20 for the drive motor 12 and a discharge fitting 22 for the fuel conveyed by the unit are situated.

In addition to the drive motor 12, a pump section 24 is also situated in the housing 10, which said pump section sections up to the front side of the housing 10 opposite to the end cover 18. The pump section 24 comprises a delivery element 26 that is driven in rotary fashion by the shaft 16 of the drive motor 12 around an axis of rotation 28. The delivery element 26 is situated in a pump chamber 30 of the pump soon 424, which said pump chamber is separated from the drive motor 12 by a wall 32 in the direction of the axis of rotation 28 of the delivery element 28, and it is separated from the outside of the housing 10 by a wall 34. The wall 32 forms a separation from the drive motor 12, and the wall 34 forms a cover section that closes the housing 10. The walls 32, 34 are situated substantially radially relative to the axis of rotation 28 of the delivery element 26. The wall 32 comprises an opening 36 out of which the shaft 16 of the drive motor 12 extends and enters the pump chamber 30. The shaft 16 can be supported in the opening 36 via a bearing 17. The pump chamber 30 is separated from the housing 10 in the radial direction in relation to the axis of rotation 28.

The unit according to a first exemplary embodiment is shown in FIGS. 1 and 2. In this embodiment, the wall 34 is formed as a single component with the housing 10. The wall 34 forms a cover section or a base of the housing 10, the hollow cylinder-shaped region of which extends in the direction of the axis of rotation 28 from the jacket of the wall 34 outward. The housing 10 with the integrated wall 34 can be composed of plastic or metal, and it can be manufactured by means of injection molding. As an alternative, the housing 10 having the integrated wall 34 can also be manufactured by means of extrusion, and it can be composed of plastic or metal. The wall 32 is inserted into the housing 10 as a separate component from the side of the drive motor 12, and it is pressed into the housing 10, for example. The internal diameter of the housing 10 can be formed stepped in shape, in order to obtain a defined radial bearing shoulder 38 for the wall 32 in the direction of the axis of rotation 28, against which the wall 32 bears. The wall 34 comprises at least one inlet opening 40, through which fuel is drawn into the pump chamber 30 when the unit is operated. The wall 32 comprises at least one discharge opening 42, through which the conveyed fuel exits when the unit is operated. The fuel then flows through the housing 10 and exits through the discharge fitting 22 on the end cover 18. The inlet opening 40 and the discharge opening 42 are arranged offset in relation to each other in the direction of rotation of the delivery element 26. The delivery element 26 is situated in the pump chamber 30 bordered by the walls 32, 34, and is driven in rotary fashion by the drive motor 12, so that it draws fuel in through the inlet opening 40 and conveys fuel under increased pressure through the discharge opening 42. Due to the fact that the wall 34 is formed as a single component with the housing 10, the pump chamber 30 is sealed off completely from the outside of the housing 10, because no joints are present that would have to be sealed off. Moreover, no separate steps are required to produce or assemble the wall 34.

The pump section 24 can be designed as a flow-type pump, for example, whereby the delivery element is an impeller ring that is provided with a plurality of blades 44 distributed around its circumference. At least one delivery passage 46, 48 designed partially annular in shape situated opposite to the vanes of the delivery element 26 is formed in the front side of at least one wall 32, 34 facing the delivery element 26 or in the front sides of both walls 32, 34. When the unit is operated, fuel is conveyed in the delivery passages 46, 48 by means of the delivery element 26 with its vanes 44, increasing the pressure of the fuel between the inlet opening

40 and the discharge opening 42. The pump section 24 can also be designed in another fashion, e.g., as an internal-gear pump or a roller-cell pump.

In FIG. 3, the unit is shown according to a second exemplary embodiment, in which the basic design is the same as in the first exemplary embodiment. In deviation from the first exemplary embodiment, however, the wall 132 is formed as a single component with the housing 110, and the wall 134 is formed as a separate component. The wall 132 thereby forms a separating wall between the drive motor 12 and the pump chamber 30. The housing 110 comprises sections designed in the shape of hollow cylinders abutting the wall 132 on both sides and extending in the direction of the axis of rotation 28. A wall 134 forming a cover section is inserted in the section of the housing 110 designed in the shape of a hollow cylinder and opposite to the drive motor 12, which said section of the housing is preferably pressed into place. The housing 110 can be formed stepped in shape in its internal diameter so that a radial bearing shoulder 50 for the wall 134 is formed, against which the said wall bears in the direction of the axis of rotation 28. The wall 134 can be secured in the housing 110 by means of edging, for example. The wall 134 comprises the inlet opening 40, and the wall 132 comprises the discharge opening 42 as well as the opening 36 out of which the shaft 16 extends. As in the first exemplary embodiment, the housing section 110 having the integrated wall 132 can be composed of plastic or metal, and it can be produced by means of injection molding or extrusion, for example. Due to the fact that the wall 132 is designed as a single component with the housing 110, no separate steps are required to manufacture and assemble them, and the pump chamber 30 is sealed off securely from the drive motor 12, because no joints are present that would have to be sealed off

What is claimed is:

1. A unit for conveying fuel having a drive motor (12) and a pump section (24) that are situated next to each other in a common housing (10; 110) designed at least nearly in the shape of a hollow cylinder, whereby the pump section (24) comprises a delivery element (26) rotating in a pump chamber (30), and a first wall (32) of the pump chamber (30) forms a boundary of the pump chamber (30) with the drive motor (12) and a second wall (34) of the pump chamber (30) forms a boundary of the pump chamber (30) with the outside of the housing (10) in the direction of the axis of rotation (28) of the delivery element (26), wherein the second wall (34) forming the boundary of the pump chamber with the outside of the housing (10) is formed as a single component with the housing (10), and wherein the first wall (32) forming the boundary of the pump chamber (30) with the drive motor (12) is completely confined inside the housing (10) as a separate component.

2. The unit according to claim 1, wherein the second wall (34) forming the boundary of the pump chamber (30) with the outside of the housing (10) comprises at least one opening (40), and the first wall (32) forming the boundary of the pump chamber (30) with the drive motor (12) comprises at least one discharge opening (42).

3. The unit according to claim 1, wherein the housing (10) having the integrated wall (34) is produced by means of injection molding.

4. The unit according to claim 1, wherein the housing (10) having the integrated wall (34) is produced by means of extrusion.

5. The unit according to claim 1, wherein the pump section (24) is designed as a flow-type pump assembly, and wherein at least one partially ring-shaped delivery passage (46, 48) is formed in the front side of at least one wall (32, 34) facing the delivery element (26).

* * * * *